US007661210B2

(12) United States Patent
Shepherd

(10) Patent No.: US 7,661,210 B2
(45) Date of Patent: Feb. 16, 2010

(54) PLOW

(76) Inventor: John D. Shepherd, 15765 Annico Dr., Lockport, IL (US) 60442

( * ) Notice: Subject to any disclaimer, the term of this patent is extended or adjusted under 35 U.S.C. 154(b) by 491 days.

(21) Appl. No.: 11/250,889

(22) Filed: Oct. 13, 2005

(65) Prior Publication Data

US 2007/0084088 A1 Apr. 19, 2007

(51) Int. Cl.
*E01H 5/04* (2006.01)

(52) U.S. Cl. ..... 37/232; 37/231; 37/268; 172/396; 172/444

(58) Field of Classification Search ..... 37/267, 37/235, 231, 268, 906, 232; 172/788, 794, 172/444, 445, 439, 445.1
See application file for complete search history.

(56) References Cited

U.S. PATENT DOCUMENTS 1,856,148 A * 5/1932 Ball ..... 172/136
2,290,060 A * 7/1942 Massey ..... 37/231
2,645,866 A * 7/1953 McGee ..... 172/817
2,654,304 A * 10/1953 Wilson ..... 172/444
2,660,445 A * 11/1953 Hauswirth ..... 280/497
2,774,155 A * 12/1956 Hipp ..... 172/145
2,899,760 A * 8/1959 Armington ..... 172/777
3,032,903 A * 5/1962 Neville ..... 37/370
3,250,026 A * 5/1966 Jocher et al. ..... 37/232
3,311,175 A * 3/1967 Richey ..... 172/136
3,341,253 A * 9/1967 Hostetter ..... 299/10
3,456,369 A * 7/1969 Leposky ..... 37/232
3,483,642 A * 12/1969 Glesmann ..... 37/232
3,587,182 A * 6/1971 Hirt ..... 37/232
3,587,751 A * 6/1971 Schmidt, Jr. ..... 172/264
3,650,054 A * 3/1972 Hanson ..... 37/232
3,684,030 A * 8/1972 Lucero ..... 172/700
3,712,383 A * 1/1973 Renahan ..... 172/264
3,882,944 A * 5/1975 Zimmerman ..... 172/832
4,044,843 A * 8/1977 Holub ..... 172/825
4,215,494 A * 8/1980 Farrell et al. ..... 37/236
4,261,115 A * 4/1981 Chittenden ..... 37/268
4,269,427 A * 5/1981 van der Lely ..... 172/445
4,313,504 A * 2/1982 Fischer ..... 172/382
4,358,241 A * 11/1982 Anderson ..... 414/703
4,369,590 A * 1/1983 Miller ..... 37/231
4,403,432 A * 9/1983 Biance ..... 37/235
4,524,532 A * 6/1985 Browning ..... 37/408
4,754,562 A * 7/1988 McGarrah et al. ..... 37/232
4,867,607 A * 9/1989 Johnson et al. ..... 405/182
4,907,357 A * 3/1990 Lilienthal ..... 37/197

(Continued)

*Primary Examiner*—Thomas A Beach
(74) *Attorney, Agent, or Firm*—Greer, Burns & Crain, Ltd.

(57) ABSTRACT

A support or hitch box supports a mounting bar in a selected vertical position. The mounting bar is received in a standard hitch receiver of any car, truck or other vehicle. A plow head is a light weight, strong, box like structure with oppositely directed mold boards so that the plow can operate in both forward and reverse directions. A linkage permits the mold board to be raised or lowered relative to the hitch box. The linkage includes upper and lower links to maintain the vertical orientation of the mold board. The plow head is mounted for pivoting in a horizontal plane. A pivot driver is user controlled to pivot the plow head and a lift driver is user operated to raise and lower the plow head. The plow head carries indicator lights. A spring, preloaded by the lift driver, applies a continuous down force to the plow head when it is the lower, plowing position.

13 Claims, 3 Drawing Sheets

U.S. PATENT DOCUMENTS 4,907,358 A * 3/1990 Moore ..... 37/232
4,976,054 A * 12/1990 Jones ..... 37/235
5,046,271 A * 9/1991 Daniels ..... 37/231
5,172,499 A * 12/1992 Griffin ..... 37/407
5,265,355 A * 11/1993 Daniels ..... 37/231
5,456,028 A * 10/1995 Larson ..... 37/404
5,595,007 A 1/1997 Biance
5,647,153 A * 7/1997 Gervais ..... 37/231
5,706,591 A * 1/1998 Wissmiller ..... 37/231
5,778,567 A * 7/1998 Jager et al. ..... 37/235
6,151,809 A 11/2000 Altheide
6,163,985 A * 12/2000 Chinnery et al. ..... 37/234
6,293,351 B1 * 9/2001 Schmidt ..... 172/439
6,334,269 B1 * 1/2002 Dilks ..... 37/235
6,343,661 B1 * 2/2002 Thompson et al. ..... 172/444
6,408,548 B1 * 6/2002 Altheide ..... 37/268
6,470,604 B1 * 10/2002 Foster et al. ..... 37/267

* cited by examiner

PLOW

FIELD OF THE INVENTION

The present invention relates to an improved plow.

DESCRIPTION OF THE PRIOR ART

A typical conventional vehicle mounted snowplow has many disadvantages.

It is mounted to the front of a truck or other vehicle at multiple attachment points, and it is time consuming to mount and unmount the plow. Also, the hardware for mounting the plow is vehicle specific. Owners of many vehicles cannot obtain a conventional plow to fit their vehicle.

The conventional plow is intended to push snow ahead of the vehicle. Effective plowing can be accomplished only when the vehicle is moving forward, and no significant plowing takes place when the vehicle is backing up. Plowing can be slow.

If an obstacle or other excessive load is encountered, the conventional plow is designed to pivot or roll over out of the way to avoid damage to the plow or vehicle. This interrupts the plowing action.

When the conventional plow is raised for transport from the lower plowing position, the plow mold board tilts or pivots relative to vertical.

Known systems for applying a down force in a conventional plow are not fast and flexible enough to accommodate uneven or rough terrain.

Although plows have been designed to be pulled behind a vehicle, some of these have been light weight plows and have not been sturdy enough to handle heavy loads. In addition, their light weight has permitted the plow to float rather than doing a good job of cleaning.

SUMMARY OF THE INVENTION

A primary object of the present invention is to provide an improved plow overcoming the above disadvantages. Specifically, the objects of the invention include providing a plow that is bidirectional and can plow in both directions; that mounts quickly to a hitch receiver of any vehicle without additional mounting or wiring; that is light yet very strong; that does not tilt or pivot when lifted; and that supplies constant down force for effective plowing over rough terrain.

In brief, in accordance with the present invention, there is provided a plow assembly for a vehicle having a tubular hitch receiver. The plow assembly includes a laterally extending plow head and a hitch box. The hitch box includes a mounting bar sized to mate with the vehicle hitch receiver. A linkage movably interconnects the plow head and the hitch box. A lift drive system raises and lowers the plow head relative to the hitch box between plowing and transport positions.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENT

Figure 1:
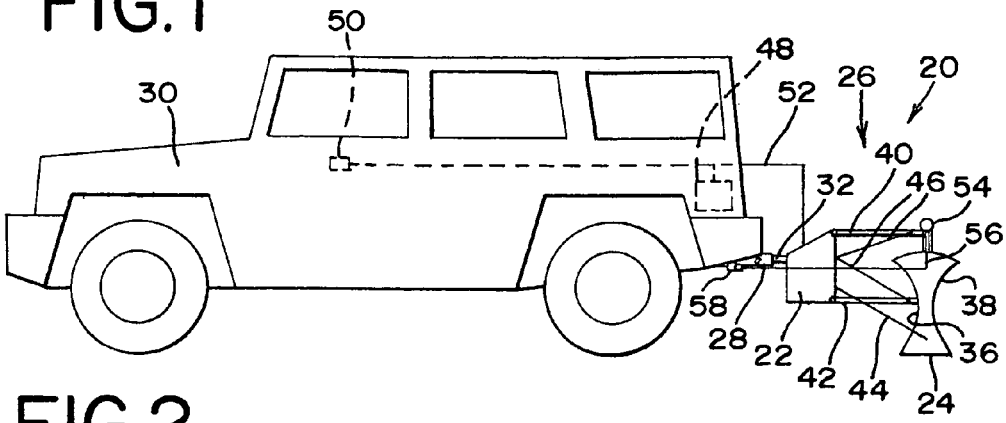
FIG. 1 is a simplified diagrammatic side elevational view of a plow of the present invention mounted at the rear of a vehicle, with the plow in its lower operating position.
Figure 2:
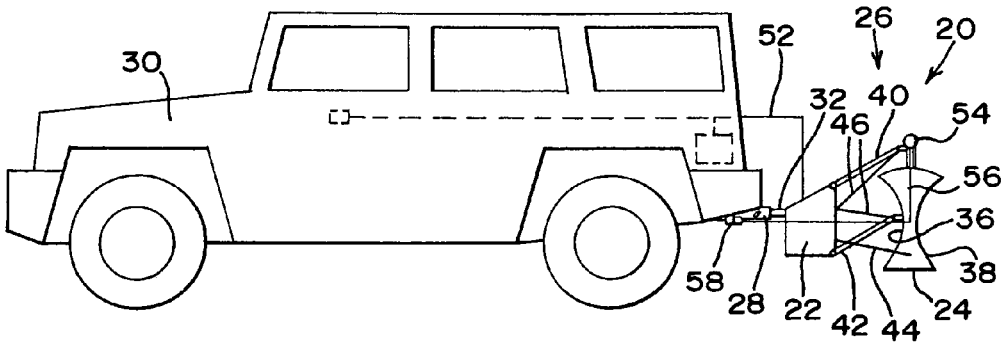
FIG. 2 is a view like FIG. 1 with the plow in its upper transport position.

Having reference now to the drawing, and initially to FIGS. 1 and 2 there is illustrated in simplified diagrammatic form a plow generally designated as 20 and constructed in accordance with the principles of the present invention. In general, the plow includes a support or hitch box 22, a plow head 24 and a linkage 26 connected between the hitch box 22 and the plow head 24.

The plow 20 is a self contained stand alone unit that is easily mounted directly to a standard, tubular, two inch square cross section hitch receiver 28 of a vehicle 30. Although the illustrated vehicle 30 is a sport utility vehicle, a plow in accordance with the present invention may be used with any vehicle having a rear or a front hitch receiver, including trucks, passenger cars, all terrain vehicles, garden tractors and any others. Hitch receivers are usually mounted at the rear of a vehicle, and the plow of the present invention is normally intended to be mounted at the rear of a vehicle. However, the plow of the present invention can be mounted at the front of any vehicle that is supplied with a front mounted hitch receiver.

The hitch box 22 includes a generally horizontally projecting hollow tubular mounting bar 32 preferably having a two inch square cross section shape to mate with the standard hitch receiver 28. The plow 20 is mounted to the vehicle 30 simply by inserting the mounting bar 32 into the hitch receiver 28 and locking the bar in place with a locking pin 34 that is inserted into aligned holes in the hitch receiver 28 and mounting bar 32. No other mounting or mechanical attaching steps are required for the plow 20 to be mounted on the vehicle and ready for use.

The plow 20 is bidirectional and can be both pulled and pushed by the vehicle 30. The plow head 24 includes two opposed mold boards 36 and 38 facing in opposite directions along the path of motion of the vehicle 30. Mold board 36 faces in, toward the vehicle 30 and mold board 38 faces out, away from the vehicle 30. As a result, for example, when vehicle 30 moves forward, the plow 20 is pulled and mold board 36 moves snow in the path of the plow. When vehicle 30 moves to the rear, the plow 20 is pushed and the mold board 38 moves snow in the path of the vehicle.

The position of the plow head 24 relative to the hitch box 22 can be changed and adjusted by the user. The linkage 26 permits the plow head 24 to be raised and lowered between the lower operating or plowing position of FIG. 1 and the raised transport position of FIG. 2. In the lower position of FIG. 1 the plow head is positioned on or near the ground or road surface and is continuously biased downward with a resilient force that permits the plow head 24 to lift and move over obstacles, rough terrain or the like. In the upper position of FIG. 2 the plow head 24 is supported above the ground or road surface so that the plow 20 does not interfere with motion of the vehicle 30 when it is not plowing.

The linkage 26 includes an upper link 40 and a lower link 42 configured so that the plow head 24 remains in the same orientation relative to vertical as it is raised and lowered. In the illustrated arrangement the axis of symmetry of the opposed mold boards 38 and 36 is vertical and remains vertical in any position of the plow head 24. In the drawings the plow head 24 is illustrated in a neutral position with the mold boards 36 and 38 perpendicular the direction of vehicle travel. The linkage 26 is designed to permit the plow head 24 to pivot horizontally in both directions from the neutral position so that plowed snow is moved by the plow head 24 laterally to one side or the other of the vehicle 30.

A pivot driver system 44 is operated by the user to pivot the plow head 24 horizontally. A lift driver system 46 is operated by the user to rise and lower the plow head 24. Movement of the plow head 24 relative to the hitch box 22 can be effected in any of a variety of ways, for example manually, hydraulically or using electrical power. In a manual system, the drivers 44 and 46 can include manually operated ball and screw linear actuators or the like. In a hydraulic system, the drivers 44 and 46 can include linear hydraulic cylinders operated from a motor pump unit mounted in the hitch box 22. In an electrical system, the drivers 44 and 46 can include electrically powered rotary winches mounted on the hitch box 22.

In a hydraulic or electrical driver system, electrical power may be provided directly from the battery of the vehicle 30 or, depending upon power requirements, from a cigarette lighter type power receptacle of the vehicle 30. In many instances it is desirable for the plow to have a dedicated power supply in the form of a battery pack power supply 48 that can be carried within the vehicle 30. Power supply 48 may include a battery charger energized from a twelve volt dc source of a 120 volt ac source or both. In addition, for convenient operation by the user, a pendant is provided including a handheld or other small control unit 50 located in the vehicle cab. A cable or harness 52 extending between the hitch box 22, battery pack 48 and control unit 52 includes power and control connections for operation and control of the drivers 44 and 46.

A pair of indicator lights 54 is supported above the plow head 24. Preferably the indicator lights 54 are located at the outer horizontal ends of the plow head 24 and serve as markers visible to the user of the ends of the plow head. The indicator lights 54 may include turn signal indicators as well as marker lights, and may be connected by a cable 56 to a standard trailer light connector socket 58 of the vehicle 30.

Figure 5:
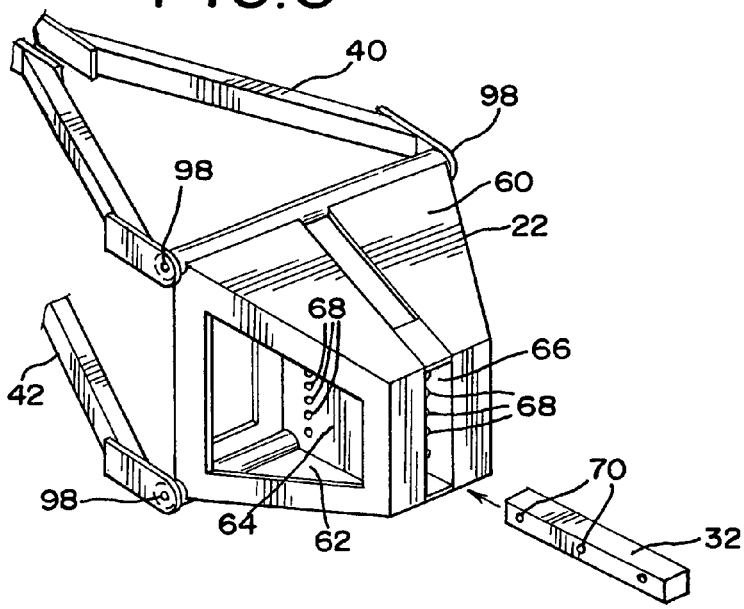
FIG. 5 is an enlarged fragmentary isometric view of the hitch box of the plow.
Figure 3:
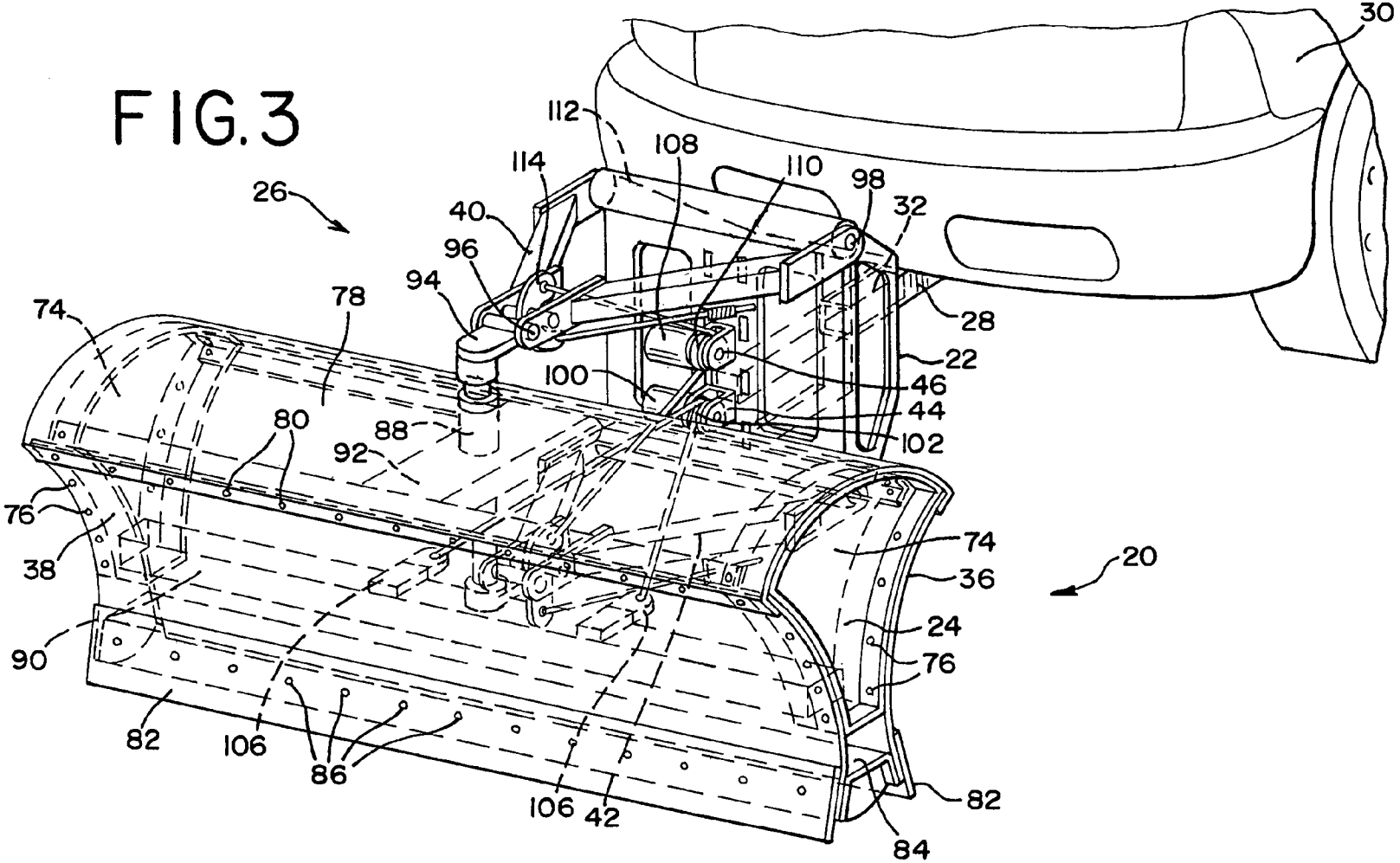
FIG. 3 is an enlarged isometric view of a preferred embodiment of the plow.
Figure 4:
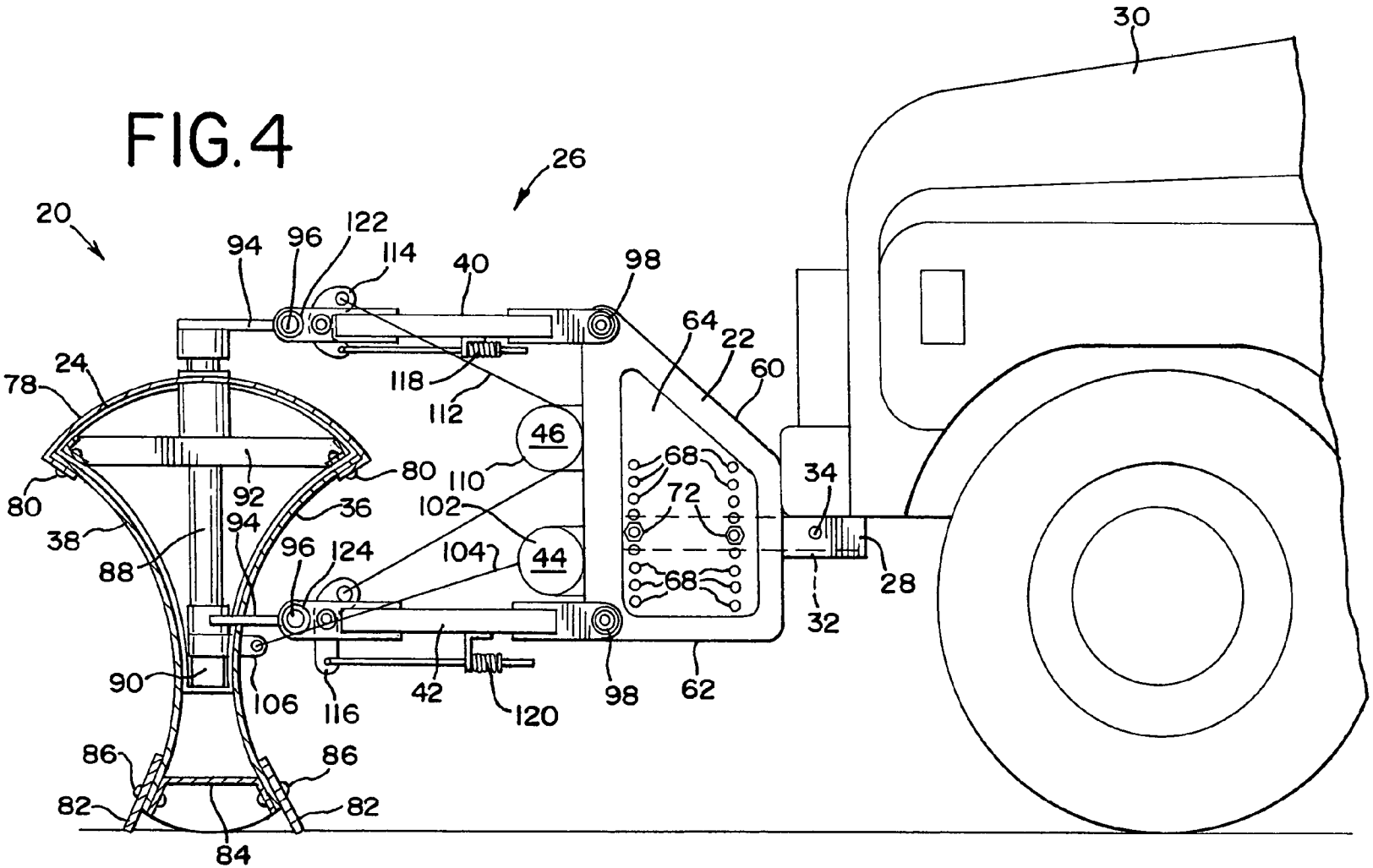
FIG. 4 side elevational view of the plow of FIG. 3.

A preferred embodiment of the present invention is seen in more detail in FIGS. 3-5. Some of the elements of the plow 20 such as the indicator lights 54 and the cables 52 and 56 are omitted in FIGS. 3 and 4 for clarity. The hitch box 22 (FIG. 5) includes upper and lower walls 60 and 62. A pair of vertical walls 64 and 66 are spaced apart to accept between them the mounting bar 32. Two vertical rows of holes 68 are provided in the walls 64 and 66. The mounting bar 32 has two mating holes 70. The mounting bar 32 is placed between the walls 60 and 62 with holes 70 aligned with selected holes 68 at a desired height. The bar 32 is then secured with a pair of fasteners 72 (FIG. 4). The hitch box 22 can be adjustably positioned at a desired height above the ground to position the plow 20 properly with vehicles of various heights.

The plow head 24 is of a sturdy yet light weight, hollow, box like construction. The ends of the mold boards 36 and 38 are attached to a pair of end walls or supports 74 by fasteners 76. A top support wall 78 is attached to the top edges of the mold boards 36 and 38 by fasteners 80. The lower edges of the mold boards 36 and 38 each support a reversible and replaceable wear bar 82. A bottom support plate 84 is attached by fasteners 86 to the wear bars 82 and to the bottom edges of the mold boards 36 and 38. The mold boards 36 and 38 and the wear bars 82 may be made of a flexible material, such as polycarbonate, so that the plow head can flex upon striking an obstruction or the like in order to avoid damage to the plow 20 or vehicle 30. If desired, parts or all of the interior of the plow head 24 may be filled with rigid foam for added strength.

A vertical support post 88 is located at the center of the plow head 24. The post 88 extends up from a laterally extending support bar 90 located within the plow head 24, and extends through an upper support bar 92 upwardly to the exterior of the plow head 24. A pair of support arms 94 extend inwardly (toward vehicle 30). The upper and lower links 40 and 42 are similar to one another and are A-frames having single point pivot connections 96 to the inner ends of the support arms 94. The A frame links 40 and 42 each have two point pivot connections 98 to the hitch box 22. When the plow head 24 is raised or lowered, the A frame links 40 and 42 maintain the plow head in the same vertical orientation. The plow head 24 pivots horizontally around the support post 88.

The pivot driver system 44 includes an electric winch having a drive motor 100 and a winch drum 102. The central portion of a winch cable 104 is would on drum 102, and the ends of the cable 104 are attached to laterally spaced tabs 106 mounted on the support bar 90. When the motor 100 rotates the drum 102 in opposite directions, the cable 104 is moved to pivot the plow head 24 horizontally in opposite directions.

The lift driver system 46 includes an electric winch having a drive motor 108 and a winch drum 110. The central portion of a winch cable 112 is wound on drum 102, and the ends of the cable 112 are attached to the ends of upper and lower pivoting levers 114 and 116. The levers 114 and 116 are pivotally attached respectively to the outer ends of the A frame links 40 and 43 adjacent the single point pivot connections 96. The opposite ends of levers 114 and 116 are connected to springs 118 and 120. The springs 118 and 120 are coiled compression springs. However other types of springs such as air springs or extension springs could be used.

When the motor 108 is operated to rotate the drum 110 in the counter clockwise direction as viewed in FIG. 4, the cable 112 is moved in the direction to tend to rotate the levers 114 and 116 in a counter clockwise direction as viewed in FIG. 4. The levers 114 and 116 engage stops 122 and 124 and further rotation is prevented. As a result, further movement of cable 112 lifts the plow head 24 up to a transport position.

When the motor 108 is operated to rotate the drum 110 in the opposite direction, clockwise as viewed in FIG. 4, the cable 112 is moved in the opposite direction to lower the plow head 24 to the plowing position near or against the ground or road surface. Further clockwise rotation results in clockwise rotation of lever 114, compressing and loading the spring 118. Spring 120 is preloaded and extends to take up slack in the cable 112. Compressed spring 118 applies a continuous resilient downward bias or down force to the plow head 12. The down force can be several hundred pounds. The plow head can deflect up or down over rough terrain, and the continuous down force results in a consistent good cleaning action. Even though the plow head 24 is very light due to its box like construction, due to the down force, it achieves results equivalent to a much heavier plow.

While the present invention has been described with reference to the details of the embodiments of the invention shown in the drawing, these details are not intended to limit the scope of the invention as claimed in the appended claims.

What is claimed is:

1. A vehicle mounted plow assembly comprising:

a support for mounting to the vehicle;

a plow head including a mold board;

a linkage connected between said support and said plow head permitting said plow head to move vertically relative to said support;

a lift driver mounted on said support for lifting and lowering said plow head relative to said support;

a spring urging said plow head in the downward direction;

the lift driver being coupled to said spring for displacing said spring to increase the spring down force; and a pivot lever pivoted relative to said plow head, said lift driver including a powered member connected between said support and said pivot lever, and said spring being connected to said pivot lever.

2. A plow assembly as claimed in claim 1, said linkage further including a pivot mount for said plow head.

3. A plow assembly as claimed in claim 2 further comprising a pivot drive system for pivoting said plow head in a generally horizontal plane.

4. A plow assembly as claimed in claim 3, said lift and pivot drive systems including electric winches.

5. A plow assembly as claimed in claim 4 further comprising a battery pack power unit connected by a cable to said electric winches.

6. A plow assembly as claimed in claim 4 further comprising a control unit connected by a cable to said electric winches.

7. A plow assembly as claimed in claim 1 further comprising indicator lights mounted at laterally opposed ends of said plow head.

8. A plow assembly as claimed in claim 1, said linkage including upper and lower links maintaining the vertical orientation of said plow head as it is lifted and lowered.

9. A plow assembly as claimed in claim 1, said plow head being bidirectional and having two opposed mold boards.

10. A vehicle mounted plow assembly comprising:

a hitch box;

a hitch mount system for mounting the plow assembly to the vehicle;

a plow head assembly including a mold board;

a linkage connected between said hitch box and said plow head assembly permitting said plow head to move vertically relative to said hitch box, and having a lift driver operably connected to a spring resiliently forcing said plow head assembly downward in a plowing position;

said linkage including an upper link and a lower link, said upper and lower links both being pivotally connected at first ends to said hitch box and being pivotally connected at second ends to said plow head assembly;

said upper and lower links being substantially equal in length; and said upper and lower links being substantially parallel to one another for maintaining a substantially constant vertical orientation of said plow head assembly during raising and lowering of said plow head assembly.

11. A plow assembly as claimed in claim 10, said plow head assembly including two opposed mold boards.

12. A plow assembly as claimed in claim 10, said hitch box including a plurality of vertically spaced bar mounting points for attaching a mounting bar at a selected height.

13. The vehicle mounted plow assembly of claim 10 wherein said upper and lower links are generally A-shaped.

* * * * *